US009493724B2

(12) United States Patent
Schroeck et al.

(10) Patent No.: US 9,493,724 B2
(45) Date of Patent: Nov. 15, 2016

(54) DELIVERY OF SUBSTANTIALLY INSOLUBLE ADDITIVES TO FUNCTIONAL FLUIDS

(75) Inventors: Calvin W. Schroeck, Willoughby Hills, OH (US); Michael R. Sutton, Matlock (GB); James D. Burrington, Gates Mills, OH (US); John K. Pudelski, Beijing (CN); Ewan E. Delbridge, Concord Township, OH (US); Jody A. Kocsis, Chagrin Falls, OH (US); Deborah A. Langer, Chesterland, OH (US); Matthew D. Gieselman, Willoughby Hills, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 183 days.

(21) Appl. No.: 13/120,695

(22) PCT Filed: Sep. 23, 2009

(86) PCT No.: PCT/US2009/057943

§ 371 (c)(1),
(2), (4) Date: May 24, 2011

(87) PCT Pub. No.: WO2010/039509

PCT Pub. Date: Apr. 8, 2010

(65) Prior Publication Data

US 2011/0218129 A1 Sep. 8, 2011

Related U.S. Application Data

(60) Provisional application No. 61/102,173, filed on Oct. 2, 2008.

(51) Int. Cl.

| | |
|---|---|
| ***C10M 177/00*** | (2006.01) |
| ***C10M 133/44*** | (2006.01) |
| ***C10M 161/00*** | (2006.01) |
| ***C10M 163/00*** | (2006.01) |
| ***C10M 165/00*** | (2006.01) |
| ***C10M 167/00*** | (2006.01) |

(52) U.S. Cl.

CPC ..... *C10M 177/00* (2013.01); *C10M 161/00* (2013.01); *C10M 163/00* (2013.01); *C10M 165/00* (2013.01); *C10M 167/00* (2013.01); *C10M 2209/086* (2013.01); *C10M 2215/086* (2013.01); *C10M 2215/28* (2013.01); *C10N 2230/54* (2013.01); *C10N 2230/72* (2013.01); *C10N 2240/04* (2013.01); *C10N 2240/042* (2013.01); *C10N 2240/044* (2013.01); *C10N 2240/08* (2013.01); *C10N 2240/10* (2013.01); *C10N 2240/40* (2013.01); *C10N 2250/10* (2013.01); *C10N 2270/00* (2013.01)

(58) Field of Classification Search

CPC ..... C10M 177/00; C10M 161/00; C10M 163/00; C10M 165/00; C10M 167/00; C10M 2209/086; C10M 2215/086; C10M 2215/28; C10N 2230/54; C10N 2230/72; C10N 2240/04; C10N 2240/042; C10N 2240/044; C10N 2240/08; C10N 2240/10; C10N 2240/40; C10N 2250/10; C10N 2270/00

USPC ..... 508/268

See application file for complete search history.

(56) References Cited

U.S. PATENT DOCUMENTS

| | | | | |
|---|---|---|---|---|
| 4,237,022 | A * | 12/1980 | Barrer | 508/290 |
| 4,280,916 | A * | 7/1981 | Richards et al. | 508/291 |
| 5,916,852 | A * | 6/1999 | Nibert et al. | 508/432 |
| 6,843,916 | B2 | 1/2005 | Burrington et al. | |
| 7,417,012 | B2 | 8/2008 | Burrington et al. | |
| 7,520,371 | B2 | 4/2009 | Lockledge et al. | |
| 7,799,745 | B2 | 9/2010 | Burrington et al. | |
| 7,833,955 | B2 | 11/2010 | Burrington et al. | |
| 2005/0137097 | A1* | 6/2005 | George et al. | 508/291 |
| 2005/0288192 | A1* | 12/2005 | Alexander | B01J 13/0065 508/287 |
| 2006/0183647 | A1* | 8/2006 | Kocsis et al. | 508/287 |
| 2007/0004604 | A1 | 1/2007 | Mathur et al. | |
| 2008/0015126 | A1 | 1/2008 | Burrington et al. | |

(Continued)

FOREIGN PATENT DOCUMENTS

| | | |
|---|---|---|
| EP | 1803792 | 7/2007 |
| WO | 2004007653 | 1/2004 |

(Continued)

OTHER PUBLICATIONS

Corresponding PCT Publication No. WO 2010/039509 A2 published Apr. 8, 2010.

(Continued)

*Primary Examiner* — James Goloboy

(74) *Attorney, Agent, or Firm* — Iken S. Sans; Christopher D. Hilker; Teresan W. Gilbert

(57) ABSTRACT

In accordance with the present invention, it has been discovered that an additive which is substantially insoluble in, has low solubility in and/or is otherwise incompatible with a functional fluid, may be supplied to the functional fluid by use of a gel composition and/or a solid additive composition containing the additive, such that the functional fluid can receive the benefit of the supplied additive and/or contain levels of the additive not otherwise achievable by conventional delivery method due to the incompatibility of the additive with the functional fluid.

5 Claims, No Drawings

(56) References Cited

U.S. PATENT DOCUMENTS

2010/0003175 A1 1/2010 Gibson

FOREIGN PATENT DOCUMENTS

| | | |
|---|---|---|
| WO | 2006081500 | 8/2006 |
| WO | WO 2006081500 A1 * | 8/2006 |
| WO | 2008070307 | 6/2008 |
| WO | 2008097823 | 8/2008 |

OTHER PUBLICATIONS

Search Report from corresponding PCT Publication No. WO 2010/039509 A3 published Aug. 12, 2010.

* cited by examiner

DELIVERY OF SUBSTANTIALLY INSOLUBLE ADDITIVES TO FUNCTIONAL FLUIDS

FIELD OF THE INVENTION

The present invention relates to a method of delivering an additive to a functional fluid, wherein the additive is substantially insoluble or has low solubility in the functional fluid. The present invention also relates to gel compositions containing the substantially insoluble or low solubility additive, and methods using such gel composition to deliver the additive to the functional fluid.

BACKGROUND OF THE INVENTION

Functional fluids degrade over time through use. The additives in the functional fluids deplete over the lifetime of the fluid in an engine or other mechanical device. The ability to supply additives to a fluid over its lifetime or use may help preserve and even improve the performance of the functional fluid and the equipment in which it is used. Time release additives for engine oil are known. These additives are typically incorporated into thermoplastic polymers which slowly dissolve into the engine oil, see U.S. Pat. No. 4,075,098. Time release additives have also been incorporated into polymers which are oil-permeable at elevated engine temperatures, see U.S. Pat. No. 4,066,559.

Replenishment of additives in a functional fluid, by using a controlled release gel or other means to add additional additive to the functional fluid, improves the performance of the functional fluid and the device using the functional fluid. Use of controlled release gels, as described in U.S. Pat. No. 6,843,916, has been shown to be an effective means to replenish a lubricant with fresh additives over time. Such gels are formed by incorporating additive components which are compatible with the functional fluid to which the additive is to be delivered into a gel matrix. These gel matrixes often result from the interaction of a basic component and an acidic component, forming the gel.

It would also be beneficial to supply certain additives to functional fluids, but in some cases these additives are not compatible with the functional fluids being used. The additive may be substantially insoluble in, have low solubility in, and/or be otherwise incompatible with the functional fluids in question, making it impossible to effectively use the additive in the functional fluid. The ability to effectively add and/or use such additives in a functional fluid would allow for improvement in the performance of the functional fluid and/or the equipment in which the functional fluid is used. There is a need to identify means of effectively adding and/or utilizing such additives in functional fluid.

The preparation and use of controlled release gels and similar compositions has been previously been described in pending and granted patents, as described above. The use of controlled release gels has been shown to be an effective means to retain critical properties of fresh lubricant by release of fresh additives over time. The conventional application is the use of gel components which are each soluble and/or otherwise compatible in the functional fluid they are to be used with, including the additives desired for controlled release from the gel into the functional fluid. In these gels the main benefit derives from release of fresh compatible additive to replace the depleted additives over the targeted service life of the fluid, providing a practical means for maintaining active additive levels in the fluid.

However, not all lubricant additives are soluble in the functional fluids in which they could be used and not all lubricant additive are soluble to the desired level and/or concentrations. Such substantially insoluble or low solubility additives often include antifoam agents, friction modifiers and other surface active chemicals, like corrosion inhibitors or rust inhibitors. The activity of the chemistry is in some cases (e.g. antifoams) associated with the insolubility. When components are substantially insoluble, it presents a challenge for lubricant formulation, which is constrained by compatibility requirement in the concentrate and the final commercial fluid.

The use of such components in the controlled release compositions and methods of the present invention overcome these constraints and thus allow the use of such substantially insoluble and/or low solubility additives which are active, but otherwise cannot be used in the functional fluids of interest because of compatibility constraints. The present invention can also allow for treatment levels of such additives which are higher than the maximum levels attainable by conventional methods due to these compatibility issues, which in some cases enables the additive to be used in the functional fluid at an optimal level previously unattainable.

Solubility is only one example of incompatibility. Other examples of incompatibilities include those associated with interactions of a supplemental additive with one or more of the other additives in a formulation. Such incompatibilities often result in haze, an increase in viscosity, solid and/or gel formation, and/or deactivation of one or more of the additives in the formulation. Another example of incompatibility is the appearance of a non typical color or dark hue as a result of the addition of a supplemental additive. Such incompatibilities would prevent such supplemental additives from being using in a formulation, even though it presence would provide a performance advantage in the functional fluid.

This practical requirement for an additive to have good solubility and/or compatibility with the functional fluid and concentrate compositions in which it is used applies across functional fluid types and applications. The requirement is necessary for the delivery of the additive to the functional fluid by conventional practices. For example, a functional fluid additive manufacturer would sell a homogeneous additive package of performance chemicals, which may then be added to a base oil to give a final lubricant, which in turn is sold in tanks, drums, cans and plastic containers for final delivery of the lubricant to the equipment to be lubricated. To maintain assurance of performance of the final lubricant, or any other functional fluid, in the equipment in which it is used, the concentrate and the lubricant must remain homogeneous throughout these steps. In other words, all of the additives present must be compatible with each of the various materials it comes into contact with and/or finds itself, from the additive package to the concentrate to the final fluid. This stringent standard greatly limits the choices of and available treatment levels for many performance additives. Many additives that could provide improved performance to a functional fluid are not widely used and/or are not used at the optimal level because the additive does not meet the solubility and/or compatibility requirements discussed above.

Without these solubility and/or compatibility limitations, greater performance and equipment protection might be achievable, including for example extended life of a lubricant or a lubricated piece of equipment such as engines, automatic transmissions, gear assemblies and the like.

Improved fuel economy and viscosity stability might be achievable as well. Greater performance may even be achievable with lesser amounts of chemical as well as greater amounts, depending on the selection of the more effective, but otherwise not suitable chemicals from a compatibility or solubility standpoint when delivered in a conventional manner.

The disclosed technology solves the problem of needing to operate within the barriers required by the usual solubility and/or compatibility standard and the limitations it demands. The inventors of the present invention have discovered that through the use of the additive containing compositions of the present invention and the methods of the present invention utilizing the same, they are freed of these encumbrances and are able to achieve the various possible performance enhancements and benefits mentioned above by enabling the use of these classes of additives and treatment levels otherwise forbidden and/or impractical. The devices include containers exposed to the functional fluid in use, also involving a gel or matrix material. The methods also include delivery via addition of solids which are able to melt or dissolve over time, like a bar of soap does in water.

SUMMARY OF THE INVENTION

In accordance with the present invention, it has been discovered that an additive which is substantially insoluble, has low solubility and/or is otherwise incompatible with a functional fluid, may be supplied to the functional fluid in such a way that the functional fluid would receive the benefit of the additive and/or contain levels of the additive not otherwise achievable by conventional delivery method due to the incompatibility of the additive with the functional fluid.

The present invention provides a method of passively delivering an active additive to a functional fluid, wherein the additive is substantially insoluble in, has low solubility in, or is otherwise incompatible with said functional fluid. This additive that is substantially insoluble in, has low solubility in, or is otherwise incompatible with the functional fluid it is to be used with and/or the additive or concentrate composition in which it would be present, is referred to herein as the "incompatible additive". The method comprises contacting the fluid with the incompatible additive, or with a composition comprising the incompatible additive, with the use of a delivery device, wherein the delivery device comprises the incompatible additive or incompatible additive containing composition and allows for its contact with the functional fluid.

The composition comprising the incompatible additive may be a gel composition, a composition that is solid at room temperature which has a melting point above the service temperature of the functional fluid to which the additive is to be added, or combinations thereof.

The incompatible additive may be any performance additive, but in some embodiments the additive is a friction modifier, a foam inhibitor, a corrosion inhibitor, or combinations thereof.

The present invention provides a method of supplying an incompatible additive to a functional fluid where the functional fluid may be an engine oil which is used in an engine. The delivery of the incompatible additive to the engine oil may result in an improvement of fuel economy, an improvement in the viscosity stability of the fluid, an improvement in service life of the fluid, or a combination thereof.

The present invention also provides for a gel composition wherein the gel is formed by a combination of: a) a basic component comprising an over-based detergent; b) an acidic component comprising a maleic anhydride styrene-copolymer, an ashless dispersant, a polyolefin, a succinated polyolefin or mixtures thereof; and c) an additive component which is substantially insoluble in, has low solubility in, or is otherwise incompatible with a functional fluid; and optionally further comprising: d) at least one additive comprising viscosity modifier(s), friction modifier(s), detergent(s), cloud point depressant(s), pour point depressant(s), demulsifier(s), flow improver(s), antistatic agent(s), dispersant(s), antioxidant(s), antifoam(s), corrosion/rust inhibitor(s), extreme pressure/antiwear agent(s), seal swell agent(s), lubricity aid(s), antimisting agent(s), or mixtures thereof.

The present invention also provides for an additive composition which is solid at room temperature comprising at least two incompatible additives; wherein the components making up the additive composition and the ratios between the components are selected to result in a solid additive composition. In some embodiments the solid composition has a melting point above the service temperature of said fluid, and in some embodiments at least degrees C. above the service temperature. In other embodiments the solid composition has a melting point at or below the service temperature of said fluid.

The invention further provides a fluid conditioning device that facilitates the contacting of a functional fluid and one or more substantially insoluble or low solubility additive containing gels of any of the embodiments described above. In one embodiment the device is free of any gel cup or container, partially or fully encasing the gel.

DETAILED DESCRIPTION OF THE INVENTION

Various preferred features and embodiments will be described below by way of non-limiting illustration.

The disclosed technology provides a combination of a delivery method or device and additives which are substantially insoluble in, not adequately soluble in, or which are otherwise incompatibility with the functional fluid and/or concentrate in which it is to be used, such that the additive is supplied to the fluid and/or is useable at levels not achievable with conventional methods of delivery. Such additives are referred to herein as "incompatible additives".

This disclosure also describes methods for the production of gel compositions and solid additive compositions, which contain substantially insoluble or low solubility active components, including friction modifiers, wherein a major portion of the benefit of supplying such additives derives from the use of higher levels of active components than would be possible in the initial fluid due to compatibility constraints.

Incompatible Additives.

The incompatible additives (that is, additives which are substantially insoluble in, have low solubility in, or are otherwise incompatible with one or more functional fluids and/or concentrates) suitable for use in the present invention may be defined as additives which cannot be used in one or more functional fluid because the additive is insoluble in and/or incompatible with the functional fluid, is not soluble enough in and/or not compatible enough with to allow for any practical treatment level in the functional fluid, or is not soluble enough in and/or not compatible enough with to allow for the optimal treatment level to be used in the functional fluid. These incompatible additives also include additives with similar solubility and/or compatibility issues with regards to the additive packages and concentrate compositions used in the preparation of functional fluids.

In some embodiments, incompatible additives, as used herein, means any additive for which there is a desire to deliver it to a functional fluid, concentrate composition and/or additive package at a level above it's maximum solubility in the material at 20 degrees C. In other words the desired level of the incompatible additive in the material, if added by conventional methods (direct addition, blending, mixing, etc) is incompatible or otherwise unacceptable in that the material, in some embodiments due to solubility limits. In such situations, the material may appear hazy and/or have sediment present and/or separate into phases and/or would form a gel or solid at 20 degrees C.

In some embodiments, the incompatible additives of the present invention are not completely soluble in oil, or a fresh functional fluid, at 20 degrees C. at concentrations of more than 0.5% or 0.1% by weight. In some embodiments, it would also be desirable to have such incompatible additives present in the functional fluid at a higher level, but for the solubility/incompatibility limitation.

For the purposes of this invention, an additive may be considered to be substantially insoluble if its solubility in mineral oil, or some other functional fluid, is less than 0.2 wt % (that is 0.2 wt % is the highest concentration of the additive that will dissolve and/or solubilize into the fluid). For the purposes of this invention, an additive may be considered to have low solubility, or be considered to be slightly soluble, if its solubility in mineral oil, or some other functional fluid, is less than 0.6 wt % (that is 0.6 wt % is the highest concentration of the additive that will dissolve and/or solubilize into the fluid).

Such additives, which could provide beneficial properties to a functional fluid but which cannot be utilized due to incompatibility issues, include those that rely on surface activity for their performance. There are several types of additives for lubricants that rely on their surface activity for their performance, often requiring marginal solubility to obtain optimal activity. These include foam inhibitors, friction modifiers, antiwear agents, and corrosion inhibitors, such as rust inhibitors. The solubility properties and overall compatibility of these additives is balance against their performance. For the additive to be effective it needs to be able to provide good performance but it also need to be compatible with the functional fluids in which it is to be used. The additive must also be compatible with the other additives that are also present in the functional fluids of interest. Generally, to be useable in the functional fluid, the additive must be able to remain in solution in the functional fluids, as well as the concentrate packages (additive packages) that are added to the functional fluids.

Additives having such incompatibility with functional fluids in which they would otherwise be useful are not overly limited and include various types of additives used in functional fluids such as lubricants and the like, including by not limited to: viscosity modifiers, friction modifiers, detergents, cloud point depressants, pour point depressants, demulsifiers, flow improvers, anti static agents, dispersants, antioxidants, antifoams, corrosion/rust inhibitors, extreme pressure/antiwear agents, seal swell agents, lubricity aids, antimisting agents, and mixtures thereof. In one embodiment, the substantially insoluble or low solubility additives used in the present invention are friction modifiers, viscosity modifiers, foam inhibitors and combinations thereof.

Friction modifiers often have a chemical structure of one or more long or fatty or waxy chains attached to one or more polar groups. Examples of friction modifiers that have solubility limits in some functional fluids include oleamide, glycerol monooleate, C12-14 dialkyl tartrate, and N-oleyl tartrimide. These materials have some limits to their solubility and/or compatibility in additive concentrates packages and/or finished fluids, but they may be considered soluble and/or compatible "enough" at low enough levels. Friction modifiers that tend to have more solubility issues and/or compatibility issues include saturated or longer chain equivalent materials, such as stearamide, glycerol monostearate, C16-18 dialkyl tartrate and N-stearyl tartrimide. These materials may very well be superior friction modifiers in various applications compared to more soluble and/or compatible friction modifiers, however these friction modifiers have significant solubility and/or compatibility issues in various functional fluids, making their use less convenient and in some cases impractical. The use of such friction modifiers are limited due to these issues and the inability to effectively deliver these additives to functional fluids with the conventional methods used.

In addition there is the possibility of using mixtures of any of the above friction modifiers with their unsaturated and/or shorter chain counterparts to provide enhanced friction reduction above that obtainable by either alone. Mixtures of different substantially insoluble or low solubility materials are also contemplated for the same potential adjustment of properties, as well as mixtures with soluble additives. The soluble additives may be in the original functional fluid or may be delivered with the substantially insoluble or low solubility additive as part of the gel composition.

Viscosity modifiers suitable for use in the present invention include those that have solubility and/or compatibility issues in one or more functional fluids. Viscosity modifiers are usually polymeric materials and as such while they may be soluble in a final lubricant, they are often not compatible with additive concentrates designed for lubricants, especially if there are other polymeric materials present, like polyisobutylene based dispersants. This is usually dealt with by adding viscosity modifiers as a separate package apart from the dispersant-detergent-inhibitor (DI) package of performance chemicals. Thus if viscosity modifiers are incorporated in a gel in a controlled released device, they may be conveniently delivered to a lubricant or other functional fluid at a desired rate, thus circumventing compatibility problems that one might have in a concentrate with other chemicals. Viscosity modifiers, including viscosity index (VI) improvers, thus would be considered substantially insoluble or low solubility for the purpose of this invention when they would be incompatible in the concentrate of additives and/or the final functional fluid.

Other examples of substantially insoluble additives which may be used in the present invention include friction modifiers such as dihexadecyl tartrate, dioctadecyl tartrate, di-C14-18 dialkyl tartrate, stearamide, oleamide, mixtures of oleamide and stearamide, oleyl tartrimide, mixtures of N-stearyl tartrimide and N-oleyl tartrimide, C24-28 alkenyl succinimide, C24-28 alkyl phenol, N-hexadecyl malimide and 1-dodecyl-5-oxo-pyrrolidine-3-carboxylic acid dodecylamide, and foam inhibitors such as trimethyl-trifluoropropylmethyl siloxane.

Method and Delivery Device.

The present invention provides a method by which one or more incompatible additives are effectively delivered to a functional fluid. That is, the present invention provides a means by which an incompatible additive, which cannot be effectively utilized in a functional fluid by conventional means due to solubility and/or other compatibility issues with the functional fluid and/or the other additives present in the functional fluid, can be used in such a functional fluid. The method of the present invention comprises the use of an additive composition which contains the incompatible additive and the contacting of the functional fluid and the additive composition, resulting in the delivery of the incompatible additive to the functional fluid.

The present invention may be utilized in any fluid conditioning device including internal combustion engines which include mobile and stationary applications; hydraulic systems; automatic transmissions; gear boxes which include manual transmissions and differentials; metalworking fluids; pumps; suspension systems; other lubricated mechanical systems; and the like. The fluid conditioning devices that can use the gel include, internal combustion engines, stationary engines, generators, diesel and/or gasoline engines, on highway and/or off highway engines, two-cycle engines, aviation engines, piston engines, marine engines, railroad engines, biodegradable fuel engines and the like; lubricated mechanical systems such as gear boxes, automatic transmissions, differentials, hydraulic systems and the like. In some embodiments, the present invention may be used with aqueous or organic functional fluids. In other embodiments the present invention is used to deliver additives to organic functional fluids only.

The functional fluids useful to being further additized through the methods and gel compositions of the present invention include gear oil, transmission oil, hydraulic fluid, engine oil, two cycle oil, metalworking fluid and the like. In one embodiment the preferred functional fluid is an engine oil. In another embodiment the preferred functional fluid is gear oil. In another embodiment the preferred functional fluid is transmission fluid. In another embodiment the preferred functional fluid is a hydraulic fluid.

The additive compositions dissolve into and/or supply the incompatible additive to a functional fluid through the contacting of the additive composition with the functional fluid. The incompatible additive containing additive composition may be a gel composition, or a solid additive composition, or a combination thereof, and the additive composition may be positioned anywhere in a system or piece of equipment where the additive composition will be in contact with the functional fluid. In one embodiment, the additive composition is positioned anywhere that the circulating functional fluid contacts the additive composition.

In one embodiment the functional fluid is an engine oil and the additive composition is positioned in the engine oil system which includes the lubricating system, filter, drain pan, oil bypass loop, canister, housing, reservoir, pockets of a filter, canister in a filter, mesh in a filter, canister in a bypass system, mesh in a bypass system, oil lines and the like. In one embodiment the functional fluid is a gear oil and the additive composition is located in the gear system which includes oil drain pan, sump, filters, a full flow or bypass oil line, lines, loop and/or filter, canisters, mesh, other spaces within the device in which a additive composition might be contained and the like. In one embodiment the functional fluid is transmission fluid and the additive composition is located in the transmission system which includes the space such as a hole within a transmission magnet, the oil pan, oil lines, lines, canisters, mesh and the like. In one embodiment the additive composition is located in the engine oil line, which includes a full flow filter, a by-pass filter, the oil pan, and the like. In one embodiment, the functional fluid is a hydraulic fluid and the additive composition is located in the hydraulic cylinder, sump, filter, oil lines, pan, full flow or by pass oil loop, line and/or filter, canister, mesh, other spaces in the system and the like.

One or more locations in a line, loop and/or the functional fluid system can contain the additive composition. Further, if more than one additive composition is used each, each additive composition can be an identical, similar and/or a different additive composition than the other additive compositions used.

In some embodiments the invention provides a container to hold the additive composition, such as a housing, a canister or a structural mesh anywhere in the functional fluid system, for example, a canister within a bypass loop of a stationary gas engine for power generation. The necessary design feature for the container is that at least a portion of the additive composition is in contact with the functional fluid. In other embodiments, the additive composition is used without such a container. In still other embodiments the additive composition is tethered, anchored, or otherwise fixed to a position within the fluid system in which the functional fluid is used and so in this way is not contained within a additive composition cup or similar container.

In some embodiments, the additive composition itself is considered to be the delivery device that enables the delivery of the substantially insoluble or low solubility additive to the functional fluid. In other embodiments the container in which the additive composition is located is considered to be the delivery device. In still other embodiments, the delivery device is considered to be a device, such as a filter, in which the additive composition, which may or may not be located within a container, is located. The primary feature of the delivery device, across all of the embodiments described, is its ability to allow for, and in some embodiments to facilitate and/or control, the contacting of the functional fluid and the additive composition.

The additive composition needs to be in contact with the functional fluid. In one embodiment the additive composition is in contact with the functional fluid in the range of about 100% to about 1% of the functional fluid in the system, in that 1 to 100% of the functional fluid comes into physical contact with the additive composition during the fluid's use. In other embodiments the additives is exposed to 1 to 100% of the flow of the functional fluid in the system. Generally speaking, as the flow rate of the functional fluid as it contacts the additive composition decreases there is less dissolution of the additive composition into the fluid, and as the flow rate increases there is greater dissolution of the additive composition.

In one embodiment, the additive composition is positioned in the functional fluid system so that the additive composition and/or spent additive composition can easily be removed, and then replaced with a new and/or recycled additive composition.

The additive composition may be added to the system by any known method depending on the total amount of additive composition and/or substantially insoluble or low solubility additive that is desired to be released over time, the desired form of the additive composition (e.g. stiffness, consistency, homogeneity and the like), the desired overall dissolution of the additive composition, the desired release rates of one or more specific components, the desired mode of operation and/or any combinations of the above.

The release rate of additive composition, that is the rate at which the substantially insoluble or low solubility additive or some other component is release from the additive composition to the functional fluid, is determined primarily by the additive composition formulation. The release rate is also dependent on the mode of addition of the additive composition, the location of additive composition, flow rate of the functional fluid, the form of the additive composition (e.g., stiffness, consistency, homogeneity and the like) and the like. The additive composition may be positioned in a location desirable for the specified and desirable dissolution rate of the additive composition components.

The additive composition of the present invention may comprise a free standing gel or a non-free standing gel. A free standing gel can be used without being contained inside a form that holds the gel's shape and dimensions. A non-free standing gel is prepared in a container from which the gel cannot be removed intact. The gel and its forming device both become part of any functional fluid conditioning device the gel is used in. A free standing gel, once formed, can be removed intact from its forming device and can be placed or built into a functional fluid conditioning device without the need of integrating the forming device into the functional fluid conditioning device. In some embodiments the free standing gel can be placed into a conditioning device, or otherwise used, without any container at all. This provides the opportunity to design the gel forming or curing container separately from the fluid conditioning device, reducing manufacturing costs of the gel and the conditioning devices. In some embodiments, considered alone or in combination with one or more of the embodiments provided both above and below, the free standing gels of the present invention are brought into contact with a functional fluid without the presence of a container or holding device surrounding or otherwise containing the gel, or if any type of container or holder is used with the gel, no side wall or similar structure is present.

Solid Compositions.

In some embodiments the additive compositions of the present invention is a solid at room temperature. In such embodiments, the additive composition is not a gel in that the composition is not a semi-solid material formed the interaction of at least one basic component and at least one acidic component. Rather, in such embodiments, the additive composition is a mixture of one or more additives that is a solid at room temperature, but that unlike a gel, will melt to form a liquid at higher temperature and will freeze to form a solid at lower temperatures.

In some embodiments the solid additive compositions have a melting point of 40 degrees C. or higher, 70 degrees C. or higher, 100 degrees C. or higher, or 130 degrees C. or higher. In some embodiments the melting point of the solid additive composition is at or below the service temperature a functional fluid reaches during its use in its designed application In those cases the additives present in the solid additive composition will be quickly released into the oil. In other embodiments, the solid additive compositions have a melting point at least just above the service temperature a functional fluid reaches during its use in its designed application to 50 degrees C. above. For example, the melting point of an additive composition designed to deliver an additive which is substantially insoluble or has low solubility in engine oil may have a melting point which is just above the temperature the engine oil reaches during its use in an operating engine. In such embodiments the formulation of the solid additive composition is carefully balanced in order to result in the desired melting point, allowing the solid additive composition to remain in solid form while exposed to the functional fluid during the service life of the functional fluid.

In some embodiments the melting point of the solid additive composition is 5 degrees C. above the service temperature of the functional fluid with which it is to be used. In other embodiments the solid additive composition is 10 degrees C. above the service temperature of the functional fluid. In still other embodiments the solid additive composition is 20 degrees C. above the service temperature of the functional fluid.

The solid additive compositions of the present invention comprises one or more of the incompatible additives described above and may further comprises any of the additives described below for components (a) and (b) that make up the gel compositions, with the proviso that the components of the solid additive compositions do not interact to form a gel. The solid additive compositions of the present invention may also comprise the optional additional additives described below for component (d). In some embodiments the amount of component (a), (b) and (c) present in the solid additive compositions of the present invention are the same as those described below of the gel compositions.

The solid additive compositions of the present invention may comprise a mixture of two or more substantially insoluble or low solubility additives. In embodiments where two components are present, the ratio of the two components, on a weight basis, is between 1:99 to 99:1. In some embodiments the ratio is 25:75 to 75:25, or 60:40 to 40:60. In other embodiments, the components themselves and the ratio of the components is selected to produce a solid composition with the desired melting point.

Gel Compositions.

In some embodiments the additive composition of the present invention is a control release additive gel composition. The controlled release gel compositions of the present invention contain the incompatible additive described above and allow for its controlled release into the functional fluid with which it is used. The gel composition may act to protect the incompatible additive being released over time from degradation, allowing the additive to improve the functional fluid's performance over a longer time period than otherwise possible, enable to additive to be present in the functional fluid at an desired concentration over a longer period of time, allow otherwise incompatible additives to be effectively delivered to a functional fluid over the course of its use, or combinations thereof.

Gel compositions suitable for use in the present invention are typically made by blending of a mixture of additives selected to simultaneously provide the desired performance and to form a gel upon mixing or mixing with subsequent thermal curing. In some embodiments, the gel composition is formed by combining at least two components selected from the group consisting of: detergents, dispersants, acids, bases, over based detergent, and succinated polyolefins. The components are selected, and combined in specific ratios, so that when combined, they form a gel.

The gels of the present invention are formed in the presence of the incompatible additive described above, resulting in a gel composition in which the incompatible additive is dissolved and/or dispersed. In some embodiments the incompatible additive does not participate in the formation of the gel matrix but is rather merely an additional additive present that gets contained within the gel composition that forms. In other embodiments, the incompatible additive actively participates in the gel formation, in that the additive itself interacts with the other components present to form the gel composition. In still other embodiments, when multiple incompatible additives are present, combinations of the embodiments described above may occur.

In some embodiments the incompatible additives can be added to, dispersed in or melted in to one or more of the components that form the gel composition. The components may then be combined to form the gel. In other embodiments, the incompatible additive may be added as a separate component to the other components present before, during or after the formation of the gel.

The gel's formulation may be composed of: (a) a basic component comprising an overbased detergent, an ashless dispersant, or mixtures thereof; (b) an acidic component comprising a maleic anhydride styrene-copolymer, an ashless dispersant, polyolefin, succinated polyolefin or mixtures thereof; (c) an additive component which is substantially insoluble in, has low solubility in, or is otherwise incompatible with a functional fluid, as described above and referred to as an "incompatible additive" herein; and (d) optionally at least one additive comprising one or more viscosity modifiers, friction modifiers, detergents, cloud point depressants, pour point depressants, demulsifiers, flow improvers, antistatic agents, dispersants, antioxidants, antifoams, corrosion/rust inhibitors, extreme pressure/antiwear agents, seal swell agents, lubricity aids, antimisting agents, or combinations thereof.

Component (a).

The basic component comprises an overbased detergent, an ashless dispersant with a total base number (TBN) greater than 13, or mixtures thereof.

Dispersants suitable for use in component (a) include ashless dispersants such as a polyisobutenyl succinimide and the like so long as the dispersant has a total base number (TBN) greater than 13. Polyisobutenyl succinimide ashless dispersants are commercially-available products which are typically made by reacting together polyisobutylene having a number average molecular weight ("Mn") of about 300 to 10,000 with maleic anhydride to form polyisobutenyl succinic anhydride ("PIBSA") and then reacting the product so obtained with a polyamine typically ethylene polyamines containing 2 to 10 nitrogen atoms per molecule.

Detergents suitable for use in component (a) include overbased sulfonates, phenates, salicylates, carboxylates, overbased calcium sulfonate detergents which are commercially-available, overbased detergents containing metals such as Mg, Ba, Sr, Na, Ca and K and mixtures thereof and the like.

Component (a) may further comprise copolymers such as ethylene-propylene diene monomer (EPDM) copolymer. Suitable ethylene-propylene diene monomer (EPDM) copolymers include those with a number average molecular weight between $1\times10^2$ and $1\times10^9$. In one embodiment component (a) comprises a copolymer, an overbased detergent, or a combination thereof. In one embodiment the copolymer comprises an ethylene-propylene diene monomer (EPDM) copolymer. In another embodiment the overbased detergent comprises an overbased calcium hydroxide alkylbenzenesulfonate detergent. In yet another embodiment the EPDM copolymer and the overbased calcium hydroxide alkylbenzenesulfonate detergent are used in combination with one another.

Component (a), the basic component, is present in ranges such that the weight ratio of component (a) to component (b) is, in one embodiment, 0.01 to 0.99, and in another embodiment 0.05 to 0.2. This corresponds to a range of about 1% by weight to about 100% by weight in one embodiment for the combined components (a) and (b) in the gel, and a range of about 1% by weight to about 50% by weight in another embodiment. As to component (a) alone, the gel may be, in one embodiment, about 0.1% by weight to about 80% by weight component (a) and in another embodiment, about 0.5% by weight to about 70% by weight component (a). In still other embodiments, component (a) is present in the gel from 0.5% by weight to 60% by weight, from 30 to 60% by weight, from 40 to 60% by weight, from 50 to 60% by weight, or from 55 to 58% by weight.

Component (b).

The acidic component may comprise a functionalized polymer with an acidic group, an ashless dispersant, a polyolefin, a succinated polyolefin or mixtures thereof.

Functionalized polymers useful in the present invention include olefin copolymers and acrylate or methacrylate copolymers. Functionalized olefin copolymers can be, for instance, interpolymers of ethylene and propylene which are grafted with an active monomer such as maleic anhydride and then derivatized with an alcohol or an amine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly useful. Solid, oil-soluble polymers such as the PIB, methacrylate, polyalkystyrene, ethylene/propylene and ethylene/propylene/1,4-hexadiene polymers, can also be used as visjcosity index improvers.

In one embodiment, the acidic component of the present invention comprises maleic anhydride styrene copolymer (MSC) and may further comprises an ashless dispersant.

The maleic anhydride styrene copolymer may be partially esterified with an alcohol where the equivalent ratio of alcohol to acid groups is in one embodiment from about 0.1 to about 0.99 and in another embodiment from 0.45 to 0.95. Appropriate alcohols for use in preparing the copolymer include alcohols containing 6 to 32 carbon atoms, and in another embodiment, alcohols containing 8 to 18 carbon atoms. Suitable maleic anhydride styrene copolymers comprise those with a total acid number (TAN), in one embodiment, greater than 1, and in another embodiment greater than 3 where TAN is in the units of equivalents of KOH per gram of material.

The ashless dispersants suitable for use in component (b) are the same as the dispersants described above in regards to component (a) except that suitable ashless dispersants for use in component (b) have a measurable total acid number (TAN). In some embodiments suitable dispersants have a TAN greater than 15. In one embodiment, component (b) comprises a polyisobutenyl succinimide dispersant.

Component (b), the acidic component, is present in ranges such that the weight ratio of component (a) to component (b) is typically 0.01 to 0.99, and more typically 0.05 to 0.2. This corresponds to a range of about 1% by weight to about 100% by weight in one embodiment for the combined components (a) and (b) in the gel, and a range of about 1% by weight to about 50% by weight in another embodiment. As to component (b) alone, the gel may be, in one embodiment, about 0.5% by weight to about 99% by weight component (b) and in another embodiment, about 0.5% by weight to about 98% by weight component (a). In other embodiment component (b) may be present in the gel from 0.1% to 40% by weight, from 0.1% to 20% by weight, from 0.1% to 10% by weight, or from 5 to 10% by weight.

Component (c).

The incompatible additive component is described in the sections above. Component (c) is present in ranges such that the weight ratio of component (c) to the combined total of components (a), (b), (c), and (d) is typically 0.001 to 0.99, and more typically 0.01 to 0.5. This corresponds to a range of about 0% by weight to about 99% by weight in one embodiment of component (c) in the gel and a range of about 1% by weight to about 50% by weight in another embodiment. In other embodiments component (c) is present in the gel from 0.1% to 40% by weight, from 0.1% to 30% by weight, from 0.1% to 15% by weight, from 10 to 20% by weight, or from 10 to 15% by weight.

Component (d).

The gel compositions may contain at least one additional desired additive for controlled release into the functional fluid. These optional gel component additives include viscosity modifier(s), friction modifier(s), detergent(s), cloud point depressant(s), pour point depressant(s), demulsifier(s), flow improver(s), anti static agent(s), dispersant(s), antioxidant(s), antifoam(s), corrosion/rust inhibitor(s), extreme pressure/antiwear agent(s), seal swell agent(s), lubricity aid(s), antimisting agent(s), and mixtures thereof with the proviso that these additional additives are not the same as the additives present in any of the other components in the gel composition, though they may be the same type of additive. The presence of one or more of these optional additives results in a controlled release gel that over time releases the desired additive(s) into a functional fluid when the gel is contacted with the functional fluid. The desired additive component is further determined by the functional fluid formulation, performance characteristics, function and the like and what additive is desired to be added for depleted additives and/or added new depending on the desired functions.

Component (d), the optional component comprising one or more desired additives for controlled release, when present, is present in ranges such that the weight ratio of component (d) to the combined total of components (a), (b), (c), and (d) is in one embodiment 0.001 to 0.99, and in another embodiment 0.01 to 0.5. This corresponds to a range of about 0% by weight to about 99% by weight in one embodiment of component (d) in the gel and a range of about 1% by weight to about 50% by weight in another embodiment. In other embodiments component (d) is present in the gel from 0 to 40% by weight, from 0 to 30% by weight, from 0 to 25% by weight, from 0 to 20% by weight, from 0 to 20% by weight, from 15 to 30% by weight, and from 15 to 25% by weight.

Suitable antioxidants include, but are not limited to alkyl-substituted phenols, sterically hindered phenols (such as 2,6-di-tert-butylphenol), and hindered ester-substituted phenols.

Suitable extreme pressure/anti-wear agents include sulfur and/or chlorosulphur EP agents, chlorinated hydrocarbon EP agents, phosphorus EP agents, or mixtures thereof.

Suitable antifoams include organic silicones such as polydimethyl siloxane, polyethylsiloxane, polydiethylsiloxane, polyacrylates and polymethacrylates, trimethyl-triflouropropylmethyl siloxane and the like.

Suitable viscosity modifiers include vinyl pyridine, N-vinyl pyrrolidone and N,N'-dimethylaminoethyl methacrylate as well as polyacrylates obtained from the polymerization of one or more alkyl acrylates.

Suitable friction modifiers include organo-molybdenum compounds, including molybdenum dithiocarbamate, and fatty acid based materials, including those based on oleic acid (such as glycerol mono oleate) and stearic acid.

Suitable anti-misting agents include very high (>100,000 Mn) polyolefins such as 1.5 Mn polyisobutylene (for example the material of the trades name Vistanex®), or polymers containing 2-(N-acrylamido)-2-methyl propane sulfonic acid (also known as AMPS®), or derivatives thereof, and the like.

Suitable corrosion inhibitors include alkylated succinic acids and anhydrides derivatives thereof, organo phosphonates and the like. The rust inhibitors may be used alone or in combination.

Suitable metal deactivators include derivatives of benzotriazoles (such as tolyltriazole and the like). Suitable demulsifiers include polyethylene oxide and polypropylene oxide copolymers and the like. Suitable lubricity aids include glycerol monooleate, sorbitan monooleate and the like. Suitable flow improvers include ethylene vinyl acetate copolymers and the like. Suitable cloud point depressants include alkylphenols and derivatives thereof, ethylene vinyl acetate copolymers and the like. Suitable pour point depressants include alkylphenols and derivatives thereof, ethylene vinyl acetate copolymers and the like. Suitable seal swell agents include organo sulfur compounds such as thiophene, 3-(decyloxy)tetrahydro-1,1-dioxide (i.e. 3-decyloxysulfolane) and the like.

In some embodiments component (d) may comprise dispersants and detergents such as those described in regards to components (a) and (b). In addition, component (d) may also comprise additional types of dispersants. These additional types of dispersants include Mannich dispersants, carboxylic dispersants, amine dispersants, and polymeric dispersants.

The Mannich dispersant are the reaction products of alkyl phenols in which the alkyl group contains at least about 30 carbon atoms with aldehydes (especially formaldehyde) and amines (especially polyalkylene polyamines).

Another class of dispersants is carboxylic dispersants. Examples of these "carboxylic dispersants" are described in U.S. Pat. No. 3,219,666.

Amine dispersants are reaction products of relatively high molecular weight aliphatic halides and amines, preferably polyalkylene polyamines. Examples thereof are described, in U.S. Pat. No. 3,565,804.

Polymeric dispersants are interpolymers of oil-solubilizing monomers such as decyl methacrylate, vinyl decyl ether and high molecular weight olefins with monomers containing polar substituents, e.g., amino alkyl acrylates or acylamides and poly-(oxyethylene)-substituted acrylates. Examples of polymer dispersants thereof are disclosed in the following U.S. Pat. Nos. 3,329,658, and 3,702,300.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds.

Optionally, other components can be added to the additive gel which includes base stock oils, inert carriers, dyes, bacteriostatic agents, solid particulate additives, and the like so long as the free standing additive gel is maintained.

In some embodiments the gels of the present invention are free from thermoplastic polymers. In such embodiments the gels of the present invention may be substantially free of thermoplastic polymers or completely free of thermoplastic polymers.

The gel compositions of the present invention exist in a semi-solid state more like a solid than a liquid, see Parker, Dictionary of Scientific and Technical Terms, Fifth Edition, McGraw Hill, © 1994. See, also, Larson, "The Structure and rheology of Complex Fluids", Chapter 5, Oxford University Press, New York, N.Y., © 1999, each which is incorporated herein by reference. The rheological properties of a gel can be measured by small amplitude oscillatory shear testing. This technique measures the structural character of the gel and produces a term called the storage modulus which represents storage of elastic energy and the loss modulus which represents the viscous dissipation of that energy. The ratio of the loss modulus/storage modulus, which is called the loss tangent, or "tan delta", is >1 for materials that are liquid-like and <1 for materials that are solid-like. The gels of the present invention have tan delta values in one embodiment of about ≤0.75, in another embodiment of about ≤0.50 and in another embodiment of about ≤0.25. The gels have tan delta values in one embodiment of about 0.1 to 0.75, in one embodiment of about 0.15 to 0.50, in one embodiment of about 0.20 to 0.33.

Another means of evaluating the firmness or stiffness of an additive gel is to measure its cone penetration value, or cone pen. Cone pens may be measured by ASTM D217 and ASTM D1403 and these test methods are often used to test the stiffness and consistency of greases. These test procedures involve measuring the amount of penetration a specifically sized and contoured cone reaches in a sample of material after a specified period of time. The smaller the cone pen value, the more stiff and/or firm the fluid additive gel. The gels of the present invention have cone pen values, measured by ASTM D 217 using a ¼ pen, as referred to in the procedure, from about 0 to about 100, in another embodiment from about 0 to about 50, and in another embodiment from about 0 to about 20. The gels have cone pen values in one embodiment of about ≤100, in one embodiment of about ≤50, in one embodiment of about ≤20. These cone pen values are in tenths of millimeters and are not adjusted for scale.

In some embodiments the gel compositions of the present invention may be free standing gel compositions. A gel is described as "free standing" when, after it is has been prepared, it is firm and solid-like enough that it can retain its shape and dimensions when removed from, and no longer supported by, a container or device, such as the container in which the gel was prepared. In some embodiments the gel retains these free-standing qualities indefinitely, in other embodiments the gel retains these qualities for at least 6 hours, for at least 1 hour, or for at least 15 minutes. In some embodiments free standing gel compositions have tan delta values, as described above, of about 0.1 to 0.33, in one embodiment of about 0.15 to 0.33, in one embodiment of about 0.20 to 0.33 or in one embodiment of about 0.21 to 0.33. In some embodiments free standing gel compositions have cone pen values, as described above, from about 40 to about 75, in another embodiment from about 40 to about 70, and in another embodiment from about 45 to about 70.

The TBN of the overbased detergent which participates in the gel-forming matrix, is normally at least 200, more typically at 300-1,000 and most typically 350 to 650. Where mixtures of overbased detergents are used, at least one should have a TBN value within these ranges. However, the average TBN of these mixtures may also correspond to these values.

The additive gel typically contains small amounts (about 5-40%) of base stock oils, which include but are not limited to mineral-based, synthetic or mixtures thereof. Optionally, an inert carrier can be used if desired. Furthermore, other active ingredients, which provide a beneficial and desired function can also be included in the gel. In addition, solid, particulate additives such as the PTFE, $MoS_2$ and graphite can also be included. In some embodiments the gel compositions of the present invention may release, in a controlled manner, these additional components, including the base stock oil, into a functional fluid.

Optionally, the dyes can be used and include halo-alkanes and the like. The dyes may be used alone or in combination. The dyes are present in the range of about 0% to about 90%, and in one embodiment in the range from about 0.0005% to about 50% and in another embodiment in the range from about 0.0025% to about 30% of the total weight of the additive gel.

Optionally, the bacterostatic agents can be used and include formaldehyde, gluteraldehyde and derivatives, kathan and the like. The bacterostatic agents may be used alone or in combination. The bacterostatic agents are present in the range of about 0% to about 90%, and in one embodiment in the range from about 0.0005% to about 50% and in another embodiment in the range from about 0.0025% to about 30% of the total weight of the additive gel.

The components of the gel composition are mixed together sequentially in any order or all together to form a mixture. After mixing of the components of the gel, a cure may be required in order for gelation to occur. If a cure is required, it is typically done in the range of about 20° C. to about 165° C. for about 1 minute to about 60 days, preferably at about 50° C. to about 120° C. for about 1 to about 24 hours, more preferably at about 85° C. to about 115° C. for about 4 to about 12 hours.

Other Additives or Solubilizers in the Functional Fluid.

Other additives present in the functional fluids used in the methods of the present invention will serve their usual functions, but may also serve as facilitators or solublizers which aid in the delivery/dissolution of the incompatible additives into the functional fluid. In some embodiments such additives include oxidation inhibitors, dispersants, detergents or antiwear agents. Friction modifiers, corrosion inhibitors, or viscosity modifiers other than those making up the substantially insoluble additives may also be present in the functional fluid for such purposes. It is also recognized that the products of oxidation may facilitate dissolution of the substantially insoluble additive. They may do this by the increase in polarity or the increase in acidity that results from the presence and/or formation or oxidation products.

Examples

The invention will be further illustrated by the following examples, which sets forth particularly advantageous embodiments. While the examples are provided to illustrate the present invention, they are not intended to limit it.

The following examples are for the preparation of two additives which have low solubility in a functional fluid in which it is desirable to use them, in this case engine oil.

Example I

N-Stearyl Tartrimide

An insoluble additive is prepared as follows: To a 5-liter 4-necked round bottom flask equipped with a mechanical stirrer, nitrogen inlet, thermowell, Dean-Stark apparatus, Friedrich's condenser, and addition funnel wrapped in thermal tape, d,1-tartaric acid (310 g, 2.07 mol) and xylenes (1388 g) are charged. The reaction is heated to 130° C. with vigorous stirring to prevent charring of the tartaric acid. Then 1-octadecylamine (557 g, 2.07 mol) is added as a solid in increments (~25 g every 15-30 mins) over an 8 hour period. After the addition of the amine is complete, the reaction is continually heated to 130° C. for 3 hours. At this temperature, the xylenes are distilled out via the Dean-Stark apparatus over a 3 hour period. Then the distillation apparatus is removed from the flask and replaced with a dry-ice cooled receiving flask. The reaction mixture is then vacuum stripped at 130° C. and <20 mm Hg for 1.5 hours.

The reaction mixture is transferred to a jar, which upon cooling is a dark brown solid (700 g). The product has a nitrogen content of 3.65 wt %, a TAN of 9.6, a TBN of 2.5, and an OH content of 5.92 wt %.

Example II

N-Oleyl Tartrimide

An insoluble additive is prepared as follows: The procedure of Example I is followed except that the 1-octadecylamine is replaced with oleylamine.

The Examples described above were evaluated in several field tests. These field tests are described below, as are the examples of gel compositions and solid additive compositions prepared for the testing where these examples contain the additives of Example I and Example II, described above.

Ford Focus™ Field Testing

The materials of Examples A-1, A-2, and A-3, described below, are tested in the 4 cylinder engine of a 2002 Ford Focus™. At the start of each test, the car engine is flushed twice and then filled with an SAE 10W-30 GF-4 motor oil which contains no added friction modifier. The engine is equipped with an oil filter with a stainless steel housing containing a custom shortened filter media to accommodate a cup to hold the gel composition or solid additive composition being tested. All other components of the oil filter were unchanged. For each test the car is driven normally. At roughly regular intervals, the engine is inspected and a sample of engine oil is taken for analysis. The testing includes the measurement of coefficient of friction (COF), percent film formation and wear scar using a PCS Instruments HFRR High Frequency Reciprocating Rig (HFRR) machine as described in the Society of Automotive Engineers paper SAE-2007-01-4134, Copyright© 2007, SAE International.

Example A-1

A gel composition is prepared by mixing: 10 pbw of an ashless dispersant derived from PIBSA and tetraethylene pentamine; 40 pbw of a partially esterified maleic anhydride and styrene copolymer; and 50 pbw of the additive of Example II. The mixture is added to a mold of a desired shape and held at 100 degrees C. for about 8 hours. The mixture forms a gel containing the insoluble additive of Example II.

Example A-2

A gel composition is prepared by mixing: 10 pbw of an ashless dispersant derived from PIBSA and tetraethylene pentamine; 40 pbw of a partially esterified maleic anhydride and styrene copolymer; and 50 pbw of the additive of Example II. The mixture is added to a mold of a desired shape and held at 100° C. for about 8 hours. The mixture forms a gel containing the insoluble additive of Example II.

Example A-3

A solid additive composition is prepared by mixing 50 pbw of the insoluble additive of Example I and 50 pbw of the insoluble additive of Example II. The composition is warmed until it is a liquid to be mixed, and is then placed in a mold of the desired shape. The mixture is allowed to cool, forming a solid additive composition of the desired shape.

Comparative Example A-1

A baseline test was completed in the Ford Focus™ using the oil described above and a standard (unmodified) oil filter.

Comparative Example A-2

A top treat test was also completed where the Example A-1 baseline was repeated except that the oil was top-treated to contain 0.25 wt % oleyl tartrimide, the additive of Example II.

In both Comparative Examples A-1 and A-2, no gel compositions or solid additive compositions were present. The results from the testing in the Ford Focus™ are summarized in the table below, however, the testing of several samples were still in progress at the time of filing.

TABLE I

Ford Focus ™ Field Testing Data

| Example ID | Testing Point (mileage) | COF | % Film Formation | Wear Scar (microns) |
|---|---|---|---|---|
| Example | 0 | 0.101 | 100% | 131 |
| A-1 | 4784 | 0.129 | 56% | 191 |
| Example | 0 | | 100% | 131 |
| A-2 | 1525 | | 60% | 182 |
| | 3780 | | 63% | 175 |
| Example | 0 | 0.101 | 100% | 131 |
| A-3 | 1499 | | 92% | 130 |
| | 2051 | | | 123 |
| Comparative | 0 | 0.116 | 61% | 147 |
| Ex A-1 | 1516 | 0.152 | 31% | 288 |
| | 4865 | 0.151 | 4% | 260 |
| Comparative | 1539 | 0.138 | 10% | 200 |
| Ex A-2 | 5683 | 0.154 | 20% | |

The results show that the controlled release of the substantially insoluble additives from the gel compositions and the solid additive composition into the oil over time provides improved performance over the baseline oil and the top treat comparative examples.

Toyota Camry™ Field Testing

The materials of Example B-1 is tested in the 4 cylinder engine of a 2005 Toyota Camry™. The field testing procedures described above are used in this field testing as well.

Example B-1

A gel composition is prepared following the procedure of Example A-1. This results in a gel containing the insoluble additive of Example II for use in the Toyota Camry™ field testing.

Comparative Example B-1

A baseline test was completed in the Toyota Camry™ using the oil described above and a standard (unmodified) oil filter.

Comparative Example B-2

A top treat test was also completed where the Example B-1 baseline was repeated except that the oil was top-treated to contain 0.25 wt % oleyl tartrimide, the additive of Example II.

In both Comparative Examples B-1 and B-2, no gel compositions or solid additive compositions were present. The results from the testing in the Toyota Camry™ are summarized in the table below:

TABLE II

Toyota Camry ™ Field Testing Data

| Example ID | Testing Point (mileage) | COF | % Film Formation | Wear Scar (microns) |
|---|---|---|---|---|
| Example B-1 | 0 | 0.101 | 100% | 131 |
| | 1516 | 0.092 | 100% | 114 |
| | 5004 | 0.116 | 99% | 145 |
| Comparative Ex B-1 | 1472 | 0.145 | 59% | 187 |
| Comparative Ex B-2 | 0 | 0.094 | 6% | 132 |
| | 1928 | 0.125 | 5% | 160 |
| | 5055 | 0.151 | 39% | 273 |

The results show that the controlled release of the substantially insoluble additives from the gel composition into the oil over time provides improved performance over the baseline oil and the top treat comparative examples.

Saturn Relay™ Field Testing

The materials of Examples C-1 and C-2, described below, are tested in the 6 cylinder engine of a 2006 Saturn Relay™. The field testing procedures described above are used in this field testing as well.

Example C-1

A gel composition is prepared following the procedure of Example A-1. This results in a gel containing the insoluble additive of Example II for use in the Saturn Relay™ field testing.

Example C-2

A solid additive composition is prepared by mixing 100 pbw of the insoluble additive of Example I. The composition is warmed until it is a liquid, and is then placed in a mold of the desired shape. The mixture is allowed to cool, forming a solid additive composition of the desired shape.

Comparative Example C-1

A baseline test was completed in the Ford Focus™ using the oil described above and a standard (unmodified) oil filter.

Comparative Example C-2

A top treat test was also completed where the Example A-1 baseline was repeated except that the oil was top-treated to contain 0.25 wt % oleyl tartrimide, the additive of Example II.

In both Comparative Examples A-1 and A-2, no gel compositions or solid additive compositions were present. The results from the testing in the Ford Focus™ are summarized in the table below, however, the testing of several samples were still in progress at the time of filing.

TABLE III

Saturn Relay ™ Field Testing Data

| Example ID | Testing Point (mileage) | COF | % Film Formation | Wear Scar (microns) |
|---|---|---|---|---|
| Example C-1 | 0 | 0.101 | 100% | 131 |
| Example C-2 | 0 | 0.101 | 100% | 131 |
| | 1491 | 0.095 | 96% | |
| Comparative Ex C-1 | 0 | 0.101 | 100% | 131 |
| | 1476 | 0.138 | 66% | 187 |
| | 4500 | 0.136 | 95% | |
| Comparative Ex C-2 | 1324 | 0.144 | 61% | |
| | 2898 | 0.148 | 68% | |

The results show that the controlled release of the substantially insoluble additives from the gel composition and the solid additive composition into the oil over time provides improved performance over the baseline oil and the top treat comparative examples.

Laboratory Testing

The materials of Examples D-1 and D-2, described below, are tested by placing 5 grams of the composition in a 250 ml beaker and adding 95 grams of Valvoline™ All Climate 10W-30 SJ oil. The mixture is then heated to 100 degrees C. and held for 5 hours. A sample of oil is taken from the beaker and analyzed to determine the percent release of the incompatible additive in the composition to the oil. This analysis is accomplished by measuring the nitrogen content of the oil and calculating the amount of the additive that must be released, relative to the total amount of additive present in the composition, to provide that measured nitrogen content of the oil.

Example D-1

An incompatible additive composition is prepared by mixing: 60 pbw of an ashless dispersant derived from PIBSA and tetraethylene pentamine; and 40 pbw of the additive of Example I. The materials are mixed at 130 degrees C. and then are added to a mold of a desired shape and held at 100 degrees C. for about 6 hours. The mixture forms a composition containing the insoluble additive of Example I.

Example D-2

An incompatible additive composition is prepared by mixing: 70 pbw of an ashless dispersant derived from PIBSA and tetraethylene pentamine; and 30 pbw of the additive of Example I. The materials are mixed at 140 degrees C. and then are added to a mold of a desired shape and held at 140 degrees C. for about 1 hours. The mixture forms a composition containing the insoluble additive of Example I.

The results from the laboratory testing of Examples D-1 and D-2 are summarized in the table below.

TABLE IV

Laboratory Testing Data

| Sample ID | Percent Additive Release |
|---|---|
| D-1 | 10.5% |
| D-2 | 14.9% |

The results from the laboratory testing show that a small but significant portion of the incompatible additive is released from the incompatible additive containing composition to the oil over the test period, in this case, 5 hours. The results show that the compositions of the present invention allow for the release of incompatible additives into functional fluids over time.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration. Unless otherwise indicated, all percentage values provided herein are weight percents.

In addition, all the embodiments described above have been contemplated as to their use, both alone and in combination, with all of the other embodiments described above, and these combinations are considered to be part of the present invention. The specific embodiments of amines and alcohols described above have been contemplated in combination with the specific embodiments of the carboxylic acids useful in the present invention.

The term passively, as used herein, and specifically with regards to the described methods of delivering an additive to a fluid, may refer to methods that do not employ mechanical dosing or similar means of active addition. In some embodiments such passive methods may include delivering additive through means of the dissolution, melting, and/or erosion of the additive containing composition and/or the diffusion, leaching, and/or extraction of additive from the composition in to the fluid. In some embodiments the methods of the present invention do not utilize any membrane, fluid permeable or semi-permeable element, screen, mesh, cover, or similar device where the device may act to separate the fluid from the additive containing composition, be positioned near the openings of a container that holds the composition, and/or acts to control the delivery of the additive from the composition to the fluid.

What is claimed is:

1. A method of passively delivering an active incompatible additive to a functional fluid, wherein the incompatible additive is substantially insoluble in, has low solubility in, or is otherwise incompatible with said functional fluid, said method comprising:

I. contacting at least a portion of said fluid with a molded form of said incompatible additive; wherein the incompatible additive:

i. is a solid at room temperature; and ii. is only N-stearyl tartrimide, N-oleyl tartrimide, or combinations thereof.

2. The method of claim 1 wherein the functional fluid comprises at least one of hydraulic fluids, automatic transmission fluids, gear box fluids, manual transmission fluids, differential fluids, metalworking fluids, suspension system fluids, engine fluids, lubricating oils, engine oils, transmission fluids, greases, gear oils, antifreeze fluids, cooling system fluids, farm tractor fluids, transformer fluids, fuels, mechanical system fluids, industrial fluids, or combinations thereof.

3. The method of claim 1 where the functional fluid is an engine oil and the delivery of said incompatible additive results in an improvement of fuel economy, an improvement in the viscosity stability of the fluid, an improvement in service life of the fluid, or a combination thereof.

4. The method of claim 1, wherein at least a portion of said functional fluid passes through a filter housing having a filter media and a cup with said incompatible additive therein.

5. The method of claim 4, wherein said functional fluid is an engine oil.

* * * * *